US007674041B2

(12) United States Patent
Frayne

(10) Patent No.: US 7,674,041 B2
(45) Date of Patent: Mar. 9, 2010

(54) PACKAGING DEVICE AND METHOD OF USING THE SAME

(75) Inventor: Shawn Frayne, Mountain View, CA (US)

(73) Assignee: Cryovac, Inc., Duncan, SC (US)

( * ) Notice: Subject to any disclaimer, the term of this patent is extended or adjusted under 35 U.S.C. 154(b) by 328 days.

(21) Appl. No.: 11/717,976

(22) Filed: Mar. 14, 2007

(65) Prior Publication Data

US 2008/0226207 A1 Sep. 18, 2008

(51) Int. Cl.

| | |
|---|---|
| ***B65D 33/01*** | (2006.01) |
| ***B65D 30/00*** | (2006.01) |
| ***B65D 30/22*** | (2006.01) |
| ***B65D 81/20*** | (2006.01) |

(52) U.S. Cl. ..... 383/101; 383/37; 383/38; 383/100; 206/524.8

(58) Field of Classification Search ..... 383/109, 383/100, 38, 907, 101, 103, 3, 37; 220/495.05; 222/175; 224/142.8, 148.4; 206/524.8, 522
See application file for complete search history.

(56) References Cited

U.S. PATENT DOCUMENTS

| | | | | |
|---|---|---|---|---|
| 3,936,334 | A | 2/1976 | Kushida et al. | |
| 4,098,434 | A | 7/1978 | Uhlig | |
| 4,159,790 | A | 7/1979 | Bailey | |
| 4,364,474 | A * | 12/1982 | Hollander, Jr. | 206/219 |
| 5,275,311 | A | 1/1994 | Piarrat | |
| 5,540,500 | A | 7/1996 | Tanaka | |
| 5,542,580 | A | 8/1996 | Hatakeyama et al. | |
| 5,615,803 | A | 4/1997 | Hatakeyama et al. | |
| 5,628,404 | A | 5/1997 | Hendrix et al. | |
| 5,810,202 | A | 9/1998 | Hoback et al. | |
| 5,901,850 | A * | 5/1999 | Jones et al. | 206/522 |
| 6,116,781 | A | 9/2000 | Skeens | |
| 6,202,849 | B1 * | 3/2001 | Graham | 206/524.8 |
| 6,247,619 | B1 * | 6/2001 | Gill et al. | 222/105 |
| 6,513,658 | B1 | 2/2003 | Adkins | |
| 6,814,491 | B1 | 11/2004 | Tang | |
| 6,874,938 | B2 | 4/2005 | Price et al. | |
| 6,997,353 | B2 | 2/2006 | Decottignies et al. | |
| 2002/0069615 | A1 * | 6/2002 | Gifford et al. | 53/412 |
| 2003/0160065 | A1 * | 8/2003 | Skillern | 222/175 |
| 2005/0220373 | A1 | 10/2005 | Wu | |

FOREIGN PATENT DOCUMENTS

| | | |
|---|---|---|
| GB | 2418838 | 4/2006 |

* cited by examiner

*Primary Examiner*—Jes F Pascua
(74) *Attorney, Agent, or Firm*—Thomas C. Lagaly

(57) ABSTRACT

A packaging device generally includes a flexible inner container, a flexible outer container, and a one-way valve in fluid communication with the inner container. Articles to be packaged are contained within the inner container, and the inner container is positioned within the outer container. When the containers are closed and pressure is applied to the outer container, ambient fluid trapped within the outer container transfers the pressure to the inner container, thereby urging fluid flow from the inner container, through the one-way valve, and out of the packaging device.

17 Claims, 16 Drawing Sheets

PACKAGING DEVICE AND METHOD OF USING THE SAME

BACKGROUND OF THE INVENTION

The present invention relates to flexible packaging devices and methods for using the same to package one or more articles therein. More particularly, the present invention relates to flexible packaging devices of a type that permits fluid to be expelled from the interior of the package, thereby reducing the volume of fluid in contact with the packaged articles.

When packaging perishable articles, such as food items, it is often desired to package such items in the substantial absence of air, as this extends the freshness/shelf-life of the packaged article by reducing the amount of air-borne oxygen that can contact and react with the article. This packaging technique is often referred to as "vacuum packaging" because a vacuum is applied to the interior of the package just before sealing the articles within package. The freshness and shelf-life of the article is thus enhanced during shipment, storage, and display at a point-of-sale facility, e.g., a grocery store, until the time that the package is opened by the end-use consumer.

For the same reasons that it is desirable to vacuum-package a perishable item for shipment and storage, it would also be desirable, from the standpoint of the end-use consumer, to have the ability to repackage any unconsumed items in a 'vacuum-like' environment, i.e., with minimal air-contact with the unconsumed items. This would both slow the rate of oxygen-degradation of the unconsumed items, and also potentially minimize the amount of storage-space required by reducing the volume of air within the package.

Any device that provides the consumer with the ability to effect in-home vacuum-packaging would ideally be simple, easy-to-use, and inexpensive. Moreover, such device would preferably be reusable and would provide air-removal in a manner that avoids crushing or otherwise damaging delicate items, such as berries, breakfast cereal, etc.

A need still exists in the art for such a device.

SUMMARY OF THE INVENTION

That need is met by the present invention, which, in one aspect, provides a packaging device, comprising:

a. a flexible inner container having (1) an interior compartment, (2) an opening into the interior compartment, (3) a closure mechanism for the opening, the closure mechanism being movable between an open position, in which the interior compartment is accessible via the opening, and a closed position, in which the interior compartment is substantially inaccessible, and (4) an egress port adapted to permit fluid flow out of the interior compartment;

b. a flexible outer container having (1) an interior compartment, (2) an opening into the interior compartment, and (3) a closure mechanism for the opening, the closure mechanism being movable between an open position, in which the interior compartment is accessible via the opening, and a closed position, in which the interior compartment is substantially inaccessible, wherein (i) the inner container is positioned within the interior compartment of the outer container such that the inner container and the opening thereof are accessible when the closure mechanism of the outer container is in the open position, and (ii) the inner and outer containers are relatively positioned such that, when the closure mechanism for the inner container is in the closed position, a volume of ambient fluid is trapped externally of the inner container and within the interior compartment of the outer container upon movement of the closure mechanism for the outer container to the closed position; and c. a one-way valve in fluid communication with the egress port in the inner container, the valve adapted to receive fluid from the egress port and direct the fluid out of the packaging device, whereby, when pressure is applied to the outer container, the ambient fluid trapped within the outer container transfers the pressure to the inner container, thereby urging fluid flow from the interior compartment of the inner container, through the egress port and the valve, and out of the packaging device.

Another aspect of the present invention is directed towards a method of packaging, comprising:

a. providing a packaging device as described above in which articles to be packaged are located in the inner container;

b. moving the closure mechanism for the inner container to the closed position, thereby enclosing the articles within the inner container;

c. moving the closure mechanism for the outer container to the closed position, thereby trapping a volume of ambient fluid within the interior compartment of the outer container, externally of the inner container; and d. applying pressure to the outer container, whereby, the ambient fluid trapped within the outer container transfers the pressure to the inner container, thereby urging fluid flow from the interior compartment of the inner container, through the egress port and the valve, and out of the packaging device.

A further aspect of the present invention is directed towards a packaging device, comprising:

a. a flexible container having (1) an interior compartment, (2) an opening into the interior compartment, (3) a closure mechanism for the opening, the closure mechanism being movable between an open position, in which the interior compartment is accessible via the opening, and a closed position, in which the interior compartment is substantially inaccessible, and (4) an egress port adapted to permit fluid flow out of the interior compartment;

b. at least one pressure chamber adjacent to the flexible container, the pressure chamber comprising at least one flexible panel sealed to an exterior surface of the container and enclosing therebetween a volume of fluid; and c. a one-way valve in fluid communication with the egress port in the container, the valve adapted to receive fluid from the egress port and direct the fluid out of the packaging device, whereby, when the closure mechanism is in the closed position, external pressure applied to the pressure chamber transfers the pressure to the container to promote fluid flow from the interior compartment of the container, through the valve, and out of the packaging device.

These and other aspects and features of the invention may be better understood with reference to the following description and accompanying drawings.

DETAILED DESCRIPTION OF THE INVENTION

Figure 1:
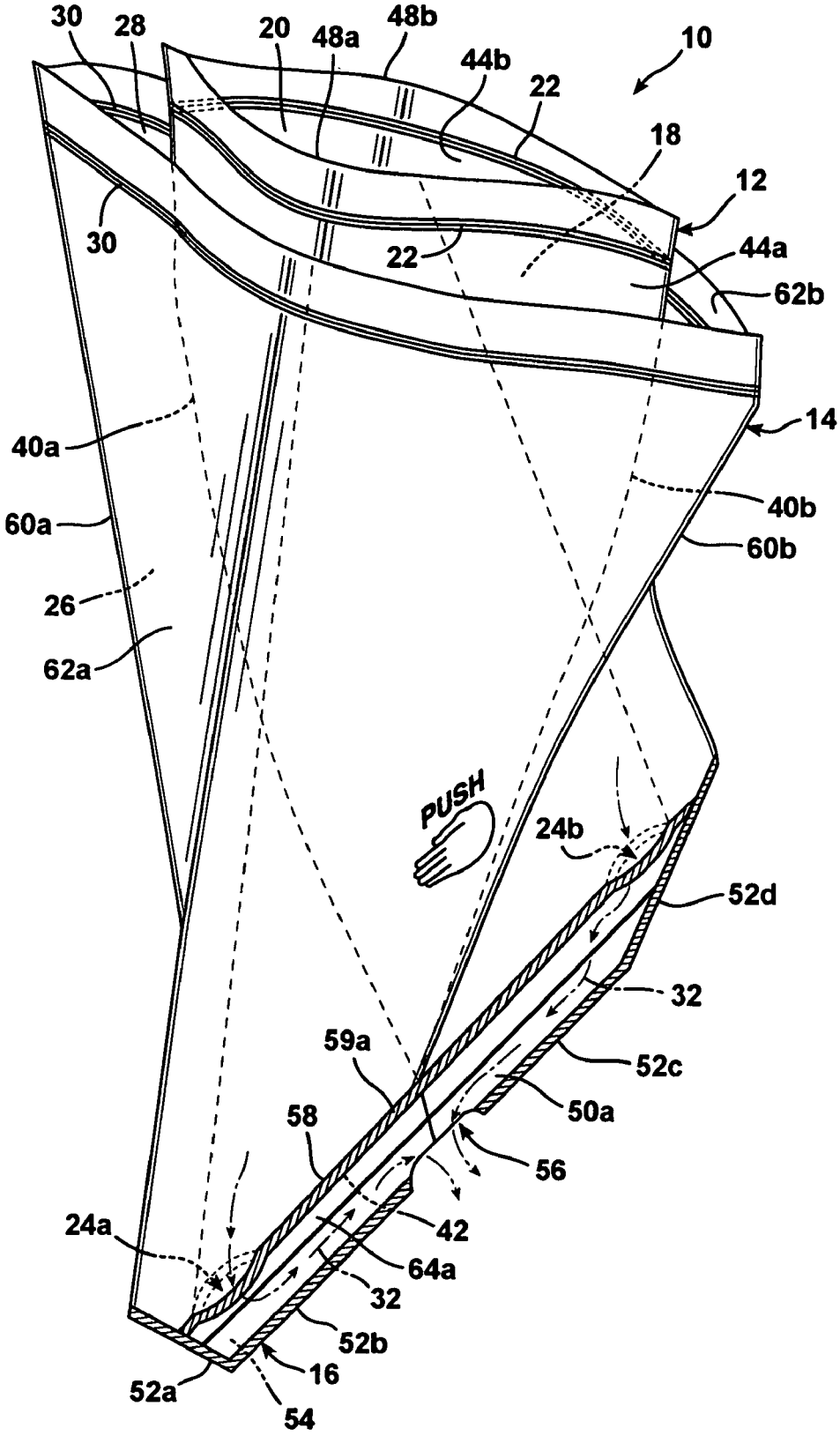
FIG. 1 is a perspective view of a packaging device in accordance with the present invention.

Referring to FIGS. 1-4, a packaging device 10 in accordance with the present invention will be described. Packaging device 10 generally includes a flexible inner container 12, a flexible outer container 14, and a one-way valve 16.

As used herein, the term "flexible" refers to materials, as well as containers and valves made from such materials, that are pliant and thus capable of undergoing a large variety of changes in shape, e.g., bending, creasing, folding, rolling, crumpling, etc., with minimal or substantially no damage to the material in response to the action of an applied shape-changing force; flexible materials are also capable of substantially returning to their general original shape when the applied force is removed.

Flexible inner container 12 includes an interior compartment 18, an opening 20 into the interior compartment 18, a closure mechanism 22 for the opening 20, and an egress port 24 adapted to permit fluid flow out of the interior compartment 18. In the illustrated embodiment, two such egress ports, 24*a* and 24*b*, are included in inner container 12. In other embodiments, a greater, e.g., three or more, or lesser number of egress ports may be included in the inner container.

Flexible outer container 14 includes an interior compartment 26, an opening 28 into the interior compartment 26, and a closure mechanism 30 for the opening 28.

One-way valve 16 is positioned such that it is in fluid communication with egress ports 24*a, b* in inner container 12. Valve 16 is adapted to receive fluid, e.g., air or other gas, from egress ports 24*a, b* and direct the fluid out of packaging device 10. This is indicated by the dashed arrows 32 in FIGS. 1-2, which also indicate the pathway that fluid will flow from the interior compartment 18 of inner container 12, through egress ports 24*a, b* and valve 16, and out of packaging device 10.

Adding FIGS. 9 and 12-15 to the present discussion, the operation of packaging device 10 will be described. Closure mechanism 22 of inner container 12 is movable between an open position (FIG. 12), in which the interior compartment 18 is accessible via opening 20, and a closed position (FIG. 13), in which the interior compartment 18 is substantially inaccessible.

Similarly, closure mechanism 30 for the outer container 14 is movable between an open position (FIGS. 12-13), in which the interior compartment 26 is accessible via opening 28, and a closed position (FIG. 14), in which the interior compartment 26 is substantially inaccessible.

Inner container 12 is positioned within the interior compartment 26 of outer container 14 such that the inner container 12 and the opening 20 thereof are accessible when the closure mechanism 30 of the outer container is in the open position. In this manner, articles 34, e.g., berries, may be placed within and/or fully or partially removed from interior compartment 18 of inner container 12.

Figure 15:
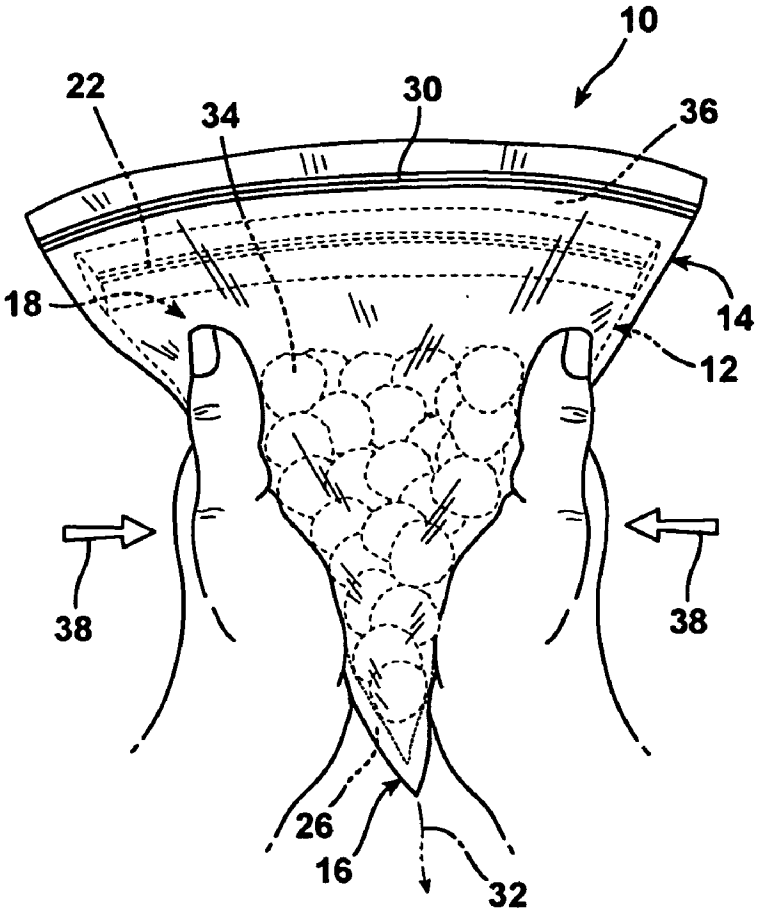
Figure 14:
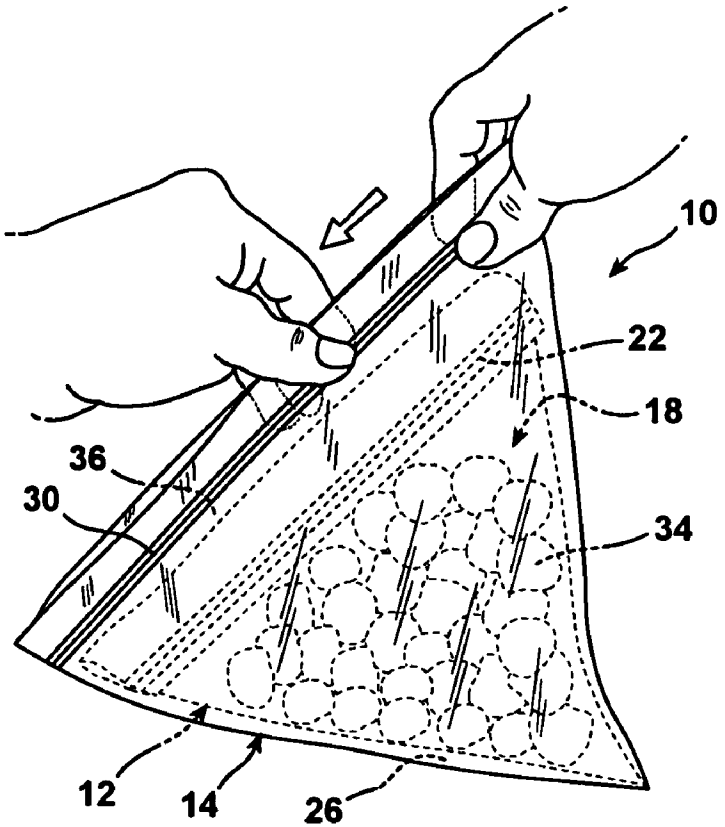

The inner and outer containers 12, 14 are relatively positioned such that, when the closure mechanism 22 for inner container 12 is in the closed position (FIG. 14), a volume of ambient fluid 36 is trapped externally of the inner container 12 and within the interior compartment 26 of outer container 14 upon movement of the closure mechanism 30 for outer container 14 to the closed position (FIGS. 14 and 15). In many applications, ambient fluid 36 will be air or other gas. However, in other applications, ambient fluid 36 could be a liquid such as water, e.g., when packaging device 10 is used in an aqueous environment.

Figure 2:
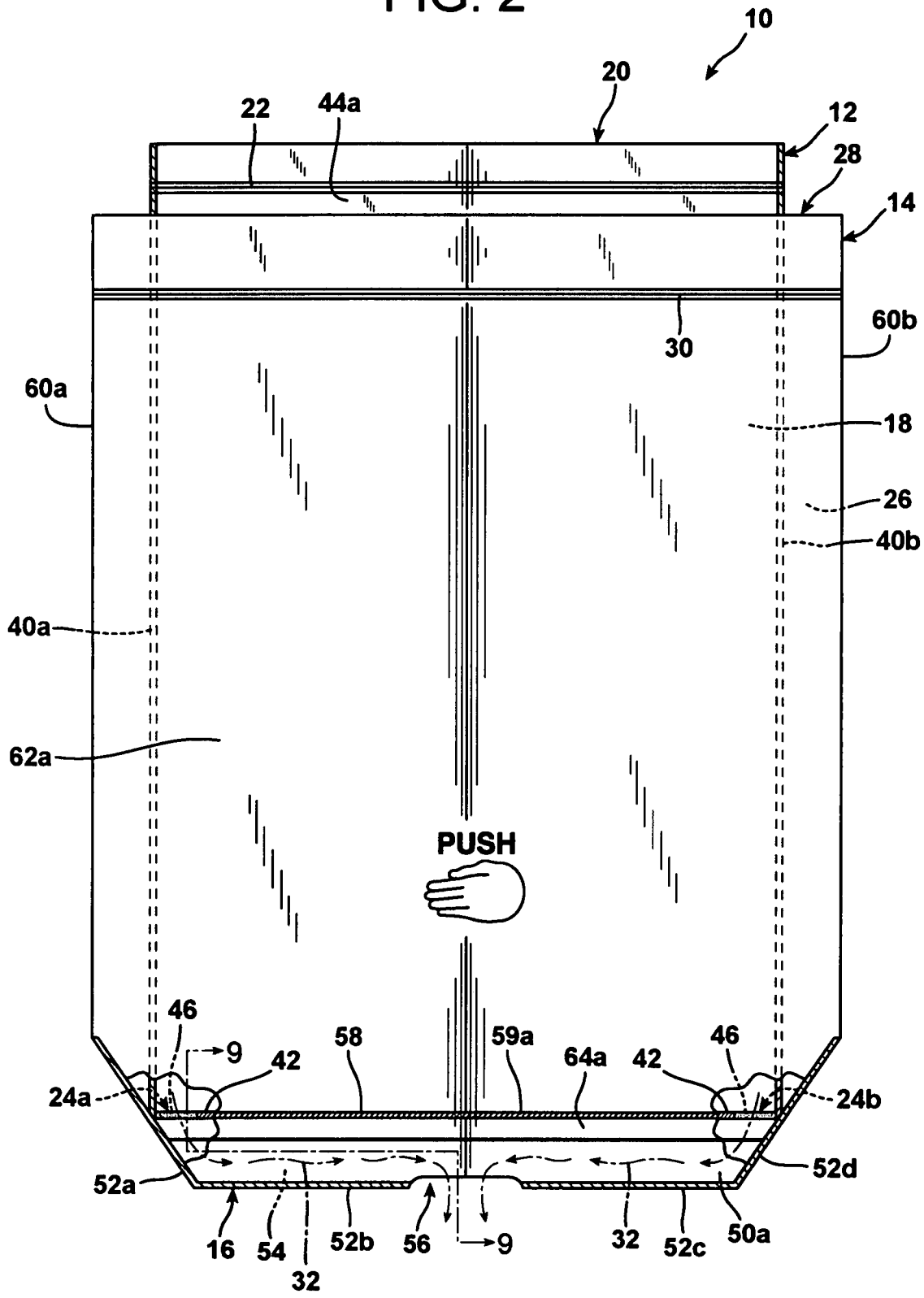
FIG. 2 is an elevational view of the packaging device shown in FIG. 1.
Figure 9:
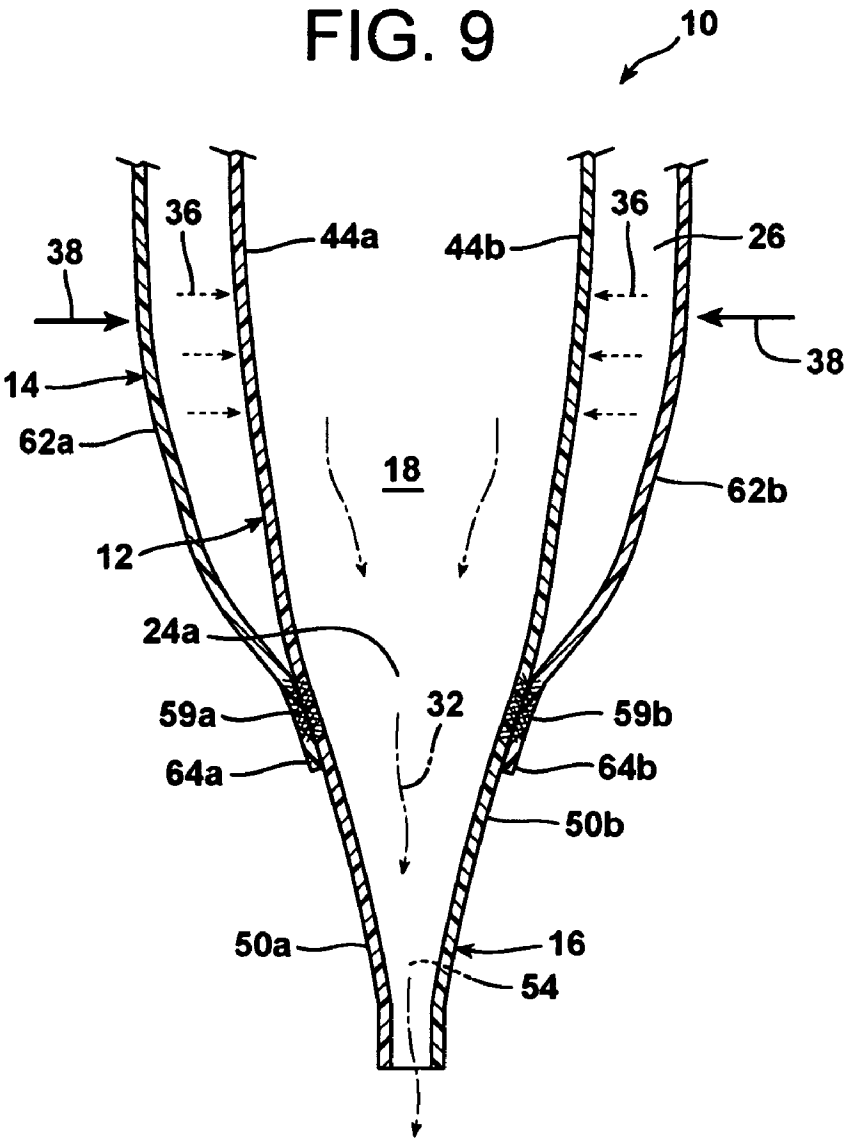
FIG. 9 is a cross-sectional view taken along line 9-9 in FIG. 2.

When pressure is applied to outer container 14, e.g., hand-pressure as shown in FIG. 15 and indicated by arrows 38, the ambient fluid 36 trapped within the outer container transfers such pressure to the inner container 12, as perhaps best shown in FIG. 9. This transfer of pressure urges fluid flow, indicated by arrows 32, from the interior compartment 18 of inner container 12, through egress ports 24*a, b* and valve 16, and out of packaging device 10. If desired, a sticker, label, printed image, etc. may be included to assist the end user in determining where to apply pressure. For example, a label with a symbol representing a hand and the word "PUSH" may be applied to opposing sides of outer container 14 as shown in FIGS. 1-2.

Figure 13:
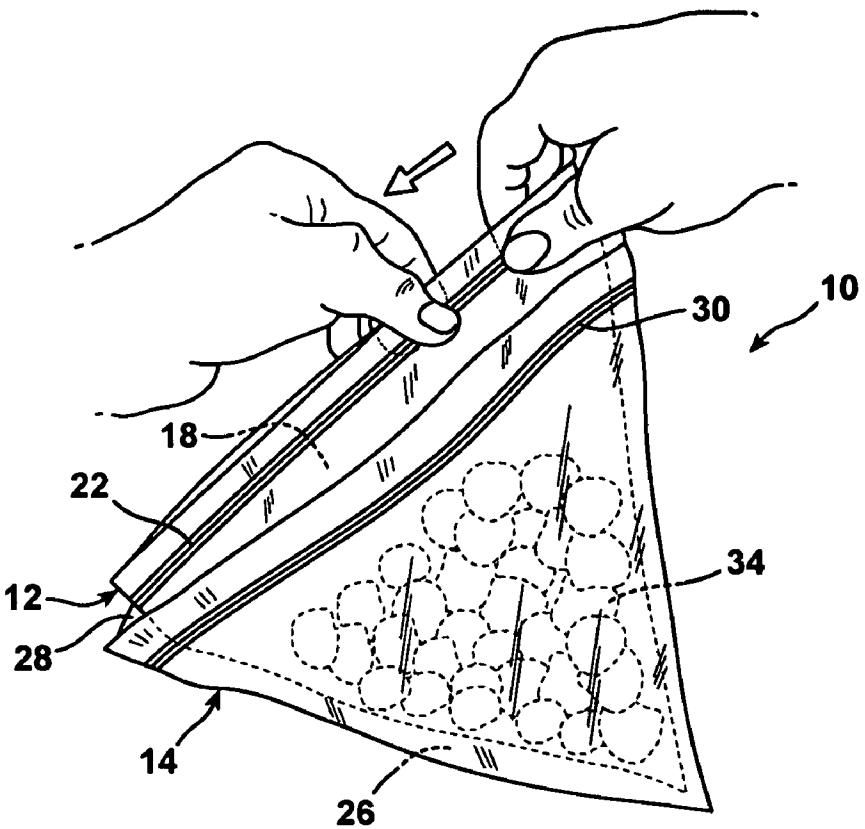
FIGS. 12-15 illustrate a process of using the packaging device shown FIG. 1 to vacuum-package food items.
Figure 12:
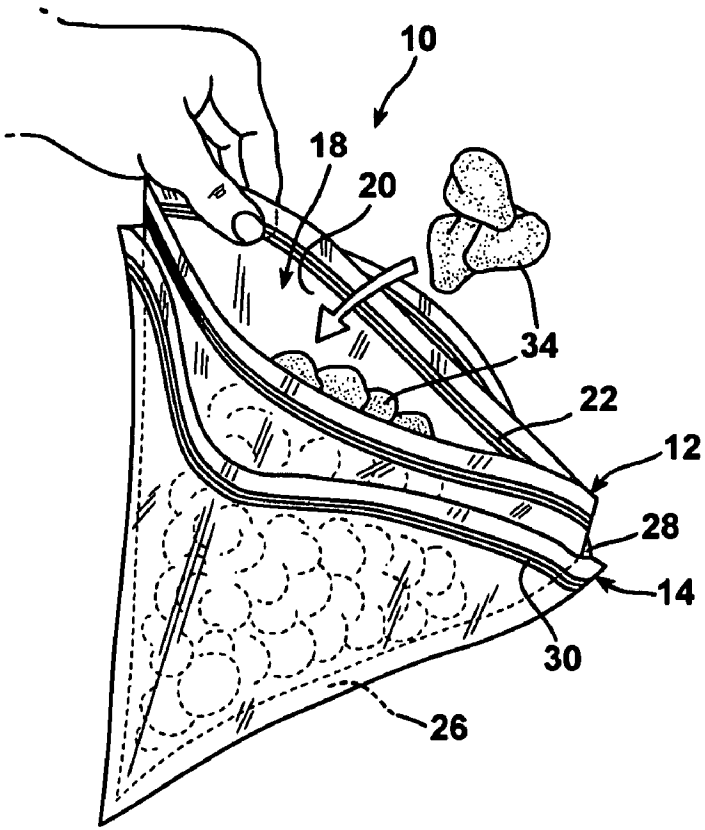

Accordingly, it may be readily appreciated that berries, cereal, coffee, lunch meat, or other types of articles 34 may be easily and quickly packaged or re-packaged in packaging device 10, in a manner that minimizes air or other fluid contact with the articles 34 by urging such fluid 32 to flow out of the interior compartment 18 in which the articles 34 are located. Such fluid, e.g., air from the ambient environment, is often enclosed within the interior compartment 18 of the inner container 12 when the closure mechanism 22 of the inner container is moved to the closed position (FIG. 13). By transferring the externally applied pressure 38 to the inner container 12 via the trapped ambient fluid 36 within the outer container 14, the pressure is uniformly applied along substantially the entire outer surface of the inner container 12. This uniform transfer of applied pressure to inner container 12 minimizes potential damage to delicate articles such as, e.g., berries, breakfast cereal, etc., by avoiding, or at least reducing, high-pressure contact points between the packaged articles 34 and externally applied pressure 38. Moreover, by transferring the applied pressure 38 to substantially the entire outer surface of the inner container, the packaging device 10 allows a significant portion of the air or other fluid retained within the interior compartment 18 of the inner container 12 to be effectively removed.

In other applications, the fluid 32 to be removed could be a liquid, e.g., water, as when device 10 is used in an aqueous, e.g., underwater, environment.

The particular type of closure mechanism 22, 30 used for the inner and outer containers is not critical. A suitable closure mechanism is one that is capable of providing a sufficiently strong fluid seal to perform the functions described herein, e.g., maintaining sufficient fluid pressure within the inner and outer containers to effect fluid flow egress from the inner container as described above. Preferably, the closure mechanism is a re-closable/re-openable type so that it, and as a result the packaging device 10 overall, can be re-used as desired. Examples of suitable closure mechanisms include an interlocking tongue-and-groove closure, e.g., a ZIPLOC® zippered or non-zippered closure, a repositionable adhesive, a clamp, etc. Another type of closure that may be employed is a Whirl-Pak® closure, which includes a flexible bar, wire, or strip of flexible film attached to the container near the opening. Closure is effected by rolling the container around bar, wire, or strip of film, thus creating a labyrinth seal (e.g., tortuous path). The bar, wire, or strip of film can then be bent, tied, or otherwise secured in the closed position.

Non-zippered, interlocking tongue-and-groove closures are illustrated. As shown, closure may be effected by applying pressure from external means, e.g., between thumb and forefinger, to the closure to force the tongue into the groove, and then sliding the thumb and forefinger along the length of the closure.

Referring again to FIGS. 1 and 2, further details of packaging device 10 will be described. The inner container 12 and/or outer container 14 may comprise a flexible pouch; each container 12, 14 is illustrated as such. Thus, for example, one or both containers may comprise a flexible pouch formed from a polyolefin film having a thickness ranging from about 0.5 to about 50 mils (1 mil=0.001 inch=0.0254 mm), such as from 0.5-40 mils, 0.5-30 mils, 0.5-20 mils, or 1-15 mils.

More generally, each container 12, 14, and also valve 16, may comprise any flexible, e.g., thermoplastic, material, such as a polyolefin film, i.e., polyethylene homopolymer or copolymer, polypropylene homopolymer or copolymer, etc. Non-limiting examples of suitable thermoplastic polymers include polyethylene homopolymers, such as low density polyethylene (LDPE) and high density polyethylene (HDPE), and polyethylene copolymers such as, e.g., ionomers, EVA, EMA, heterogeneous (Zeigler-Natta catalyzed) ethylene/alpha-olefin copolymers, and homogeneous (metallocene, single-cite catalyzed) ethylene/alpha-olefin copolymers. Ethylene/alpha-olefin copolymers are copolymers of ethylene with one or more comonomers selected from $C_3$ to $C_{20}$ alpha-olefins, such as 1-butene, 1-pentene, 1-hexene, 1-octene, methyl pentene and the like, in which the polymer molecules comprise long chains with relatively few side chain branches, including linear low density polyethylene (LLDPE), linear medium density polyethylene (LMDPE), very low density polyethylene (VLDPE), and ultra-low density polyethylene (ULDPE). Various other materials are also suitable such as, e.g., polypropylene homopolymer or polypropylene copolymer (e.g., propylene/ethylene copolymer), polyesters, polystyrenes, polyamides, polycarbonates, etc. The film may be monolayer or multilayer and can be made by any known coextrusion process by melting the component polymer(s) and extruding or coextruding them through one or more flat or annular dies. Composite, e.g., multilayered, materials may be employed to provide a variety of additional characteristics such as durability, enhanced gas-barrier functionality, etc.

As illustrated, inner container 12 may have a pair of generally opposed side edges 40*a, b*, and a substantially closed end 42, which is spaced from opening 20 such that interior compartment 18 is disposed between opening 20 and closed end 42. Inner container 12 may thus be viewed as comprising a pair of generally opposed film plies 44*a, b*, with interior compartment 18 defined or bounded by such film plies 44*a, b*, in conjunction with opening 20, closed end 42, and side edges 40*a, b*. Closed end 42 may be formed by sealing, e.g. heat-sealing, the film plies 44*a, b* as shown.

Figure 3:
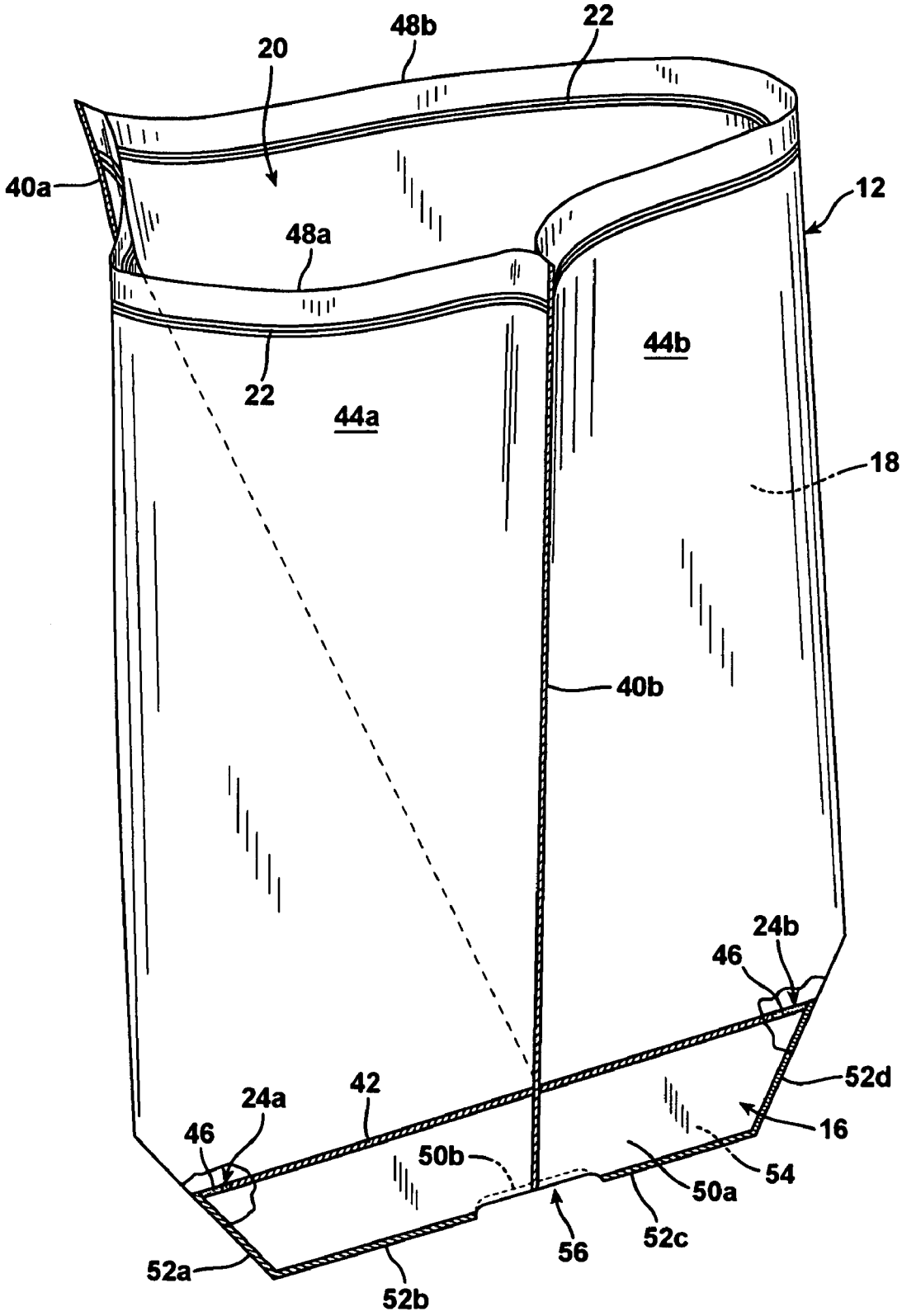
FIG. 3 is a perspective view of the inner container component of the packaging device shown in FIG. 1.

From FIGS. 1 and 3, it may be seen that the opening 20 of inner container 12 may comprise a pair of opposed film edges 48*a, b*, which may be relatively movable. In this manner, the closure mechanism 22, which may be positioned near the film edges 48*a, b*, may be made movable between the open and closed positions as described above.

From FIGS. 1 and 3, it may also be seen that opening 20 may be arranged at an angle relative to closed end 42. As shown, such angle is approximately 90°, but may be any desired angle ranging, e.g., from 0° to 180°. It has been found that arranging the opening 20 at an angle to closed end 42 facilitates the relative positioning of the inner and outer containers 12, 14 such that a volume of ambient fluid 36 is trapped externally of inner container 12 and within the interior compartment 26 of outer container 14 when the closure mechanisms 22, 30 for inner, outer containers 12, 14 are moved to their respective closed positions. By employing such an angle, inner container 12 assumes more of a three-dimensional shape than if the opening 20 and closed end 42 are substantially parallel. The three-dimensional shape, in turn, serves to prop-open the outer container as the closure mechanism 30 is closed, thereby increasing the amount of ambient fluid, e.g., air, that is trapped within the outer container, relative to a flatter inner container.

In the configuration shown, i.e., with the opening 20 and closed end 42 arranged at a relative angle of approximately 90°, inner container 12 has a substantially tetrahedron-shaped structure. Other shapes and configurations are, of course, possible, some of which are described below.

With continuing reference to FIGS. 1-3, it may be seen that one-way valve 16 may be positioned adjacent to closed end 42. More specifically, one-way valve 16 may be formed, in part, by closed end 42. That is, closed end 42 may form a boundary for one-way valve 16, with interior compartment 18 being on one side of the boundary and one-way valve 16 being on the other side. Fluid communication between the interior compartment 18 and one-way valve 16 via egress ports 24*a, b* may be effected by including at least one open, e.g., unsealed, region in the closed end 42, with the egress ports being formed by such open regions. As shown, two open regions are formed in closed end 42, with egress ports 24*a, b* being formed by such open regions. When closed end 42 is formed by a seal, e.g., a heat-seal, egress ports 24*a, b* may be formed by simply not forming a seal in the area(s) in which an egress port is desired. To facilitate the desired non-formation of a seal in the desired areas for the egress ports, a non-sealable substance 46, e.g. a heat-resistant coating, may be applied between the film plies 44*a, b* as shown. A further advantage of using a non-sealable substance 46 in this manner will be explained below.

One-way valve 16 may further comprise a pair of juxtaposed film plies 50*a, b* extending from closed end 42 (see also FIG. 9). Film plies 50*a, b* can be independent of containers 12, 14 or, as shown, may be extensions of film plies 44*a, b* that extend beyond closed end 42 of inner container 12.

Valve 16 may further include one or more seals 52*a*, 52*b*, 52*c*, and 52*d* to define a channel 54 within valve 16, and an outlet 56 in fluid communication with channel 54. Outlet 56 is adapted to permit fluid flow 32, i.e., from interior compartment 18 via egress ports 24*a, b*, out of channel 54 and, therefore, out of packaging device 10. This may be effected by positioning outlet 56, and perhaps also at least a portion of channel 54, externally of interior compartment 18 of inner container 12, and also externally of interior compartment 26 of outer container 14 as shown.

Accordingly, once a desired amount of fluid is removed from interior compartment 18, the application of pressure 38 may be stopped to thereby stop the driving force urging fluid 32 out of the interior compartment 18. Fluid pressure within channel 54 then decreases to the point that the air pressure of the ambient environment, to which the outlet 56 and channel 54 are exposed, forces film plies 50*a, b* together, thereby sealing closed the channel 54 and substantially preventing air from entering the channel via outlet 56. In this manner, air is substantially prevented from entering the interior compartment 18 of inner container 12 once the fluid removal process has been completed. As may be appreciated, valve 16 thus allows fluid to flow in substantially only one direction, i.e., out of container 12; hence, the term 'one-way valve.'

Figure 4:
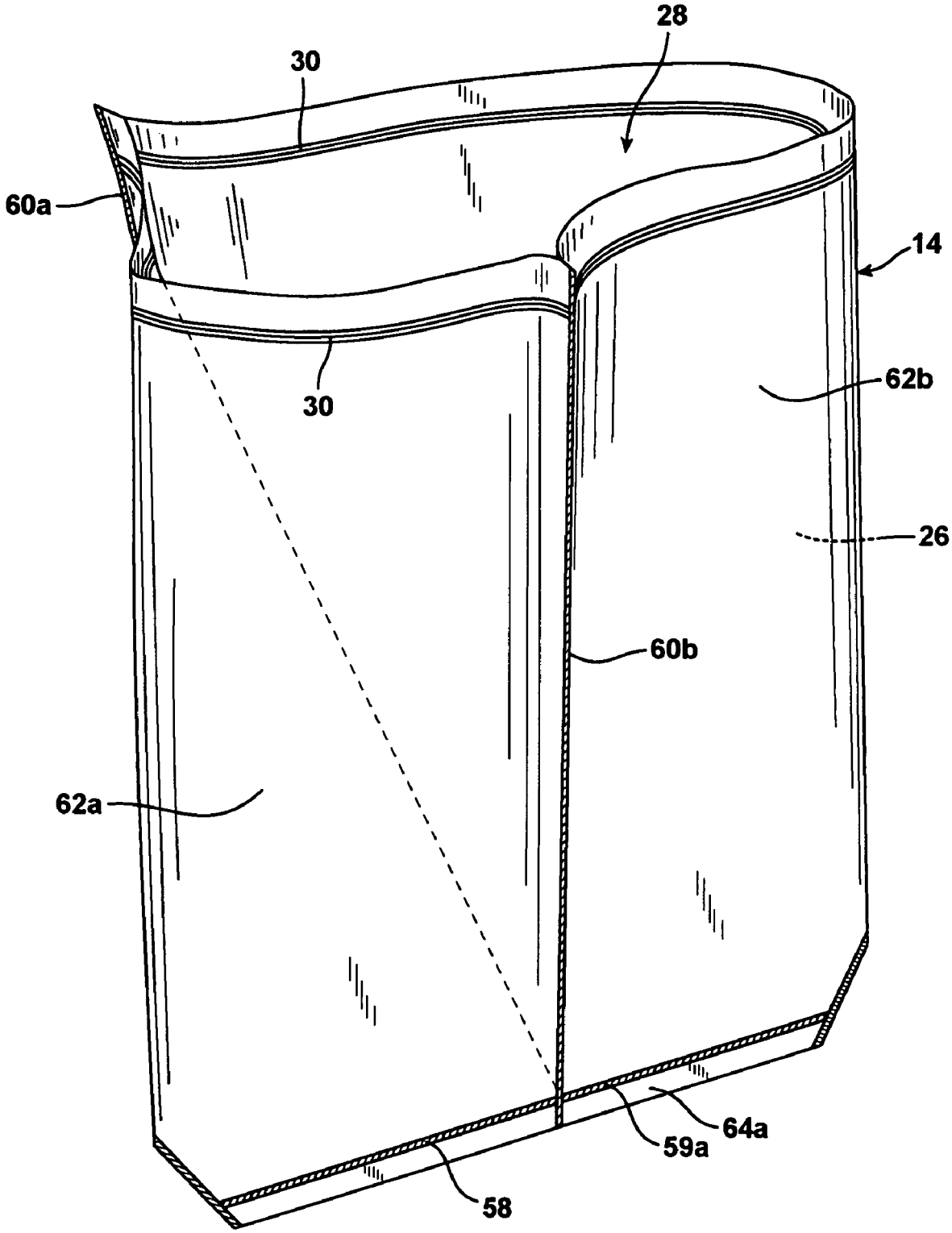
FIG. 4 is a perspective view of the outer container component of the packaging device shown in FIG. 1.

As may also be seen from the drawings, outer container 14 may comprise a substantially closed end 58, which is spaced from opening 28 such that the interior compartment 26 of outer container 14 is disposed between the opening 28 and closed end 58 (FIGS. 1, 2 and 4). Outer container 14 may also have a pair of side edges 60*a, b*, which join a pair of generally opposed film plies 62*a, b*. Interior compartment 26 is thus defined or bounded by film plies 62*a, b*, in conjunction with opening 28, closed end 58, and side edges 60*a, b*. Closed end 58 may be formed by sealing, e.g., heat-sealing, the film plies 62*a, b* as shown.

In the illustrated embodiment, closed end 58 of outer container 14 may overlay the closed end 42 of inner container 12. Advantageously, this allows a single heat-seal to be employed to create both of the closed ends in a simultaneous fashion. By coating a non-sealable substance 46 in the areas in which egress port(s) 24 are desired, this single sealing operation can be carried out to simultaneously create both closed ends and, at the same time, egress port(s) 24 by not sealing through closed end 42 in the region(s) thereof in which the egress port(s) is desired.

As shown perhaps most clearly in FIG. 9, the seal that may be used to created closed end 58 of outer container 14 may comprise two seals, 59*a* and 59*b*. This is because, in the presently-illustrated embodiment, the bottom of outer container 14 may be open, e.g., slit open, with the resulting two bottom edge regions 64*a, b* of respective film plies 62*a, b* being sealed to the inner container 12 and/or one-way valve 16 via separate seals 59*a, b*, respectively. Alternatively, as illustrated, the bottom edge regions 64*a, b* of film plies 62*a, b* may be sealed to the intersection between the inner container 12 and one-way valve 16, i.e., to the closed end 42 of inner container 12 in an overlying manner as noted above. In this configuration, one-way valve 16 is positioned adjacent to the closed end 58 of the outer container 14.

Like inner container 12, outer container 14 may be configured such that the opening 28 thereof is arranged at an angle relative to closed end 58 (FIG. 1). As shown, such angle may be approximately 90°, such that outer container has a substantially tetrahedron-shaped form. Any desired angle may be employed, ranging, e.g., from 0° to 180°, to provide any desired form to the outer container. One or, as shown, both, of the inner and outer containers 12, 14 may have such angled configuration.

Referring now to FIGS. 5-8, an alternative embodiment of the invention will be described. Alternative packaging device 100 in accordance with the present invention generally includes a flexible inner container 112, a flexible outer container 114, and a one-way valve 116.

Inner container 112 includes an interior compartment 118, an opening 120 into the interior compartment 118, a closure mechanism 122 for the opening 120, and an egress port 124 adapted to permit fluid flow out of the interior compartment 118. In the illustrated embodiment, two such egress ports, 124*a* and 124*b*, are included in inner container 112.

Flexible outer container 114 includes an interior compartment 126, an opening 128 into the interior compartment 126, and a closure mechanism 130 for the opening 128.

One-way valve 116 is positioned such that it is in fluid communication with egress ports 124*a, b* in inner container 112. Valve 116 is adapted to receive fluid, e.g., air or other gas, from egress ports 124*a, b* and direct the fluid out of packaging device 100. This is indicated by the dashed arrows 132 in FIGS. 5-6, which indicate the pathway that fluid will flow from the interior compartment 118 of inner container 112, through egress ports 124*a, b* and valve 116, and out of packaging device 100.

Figure 11:
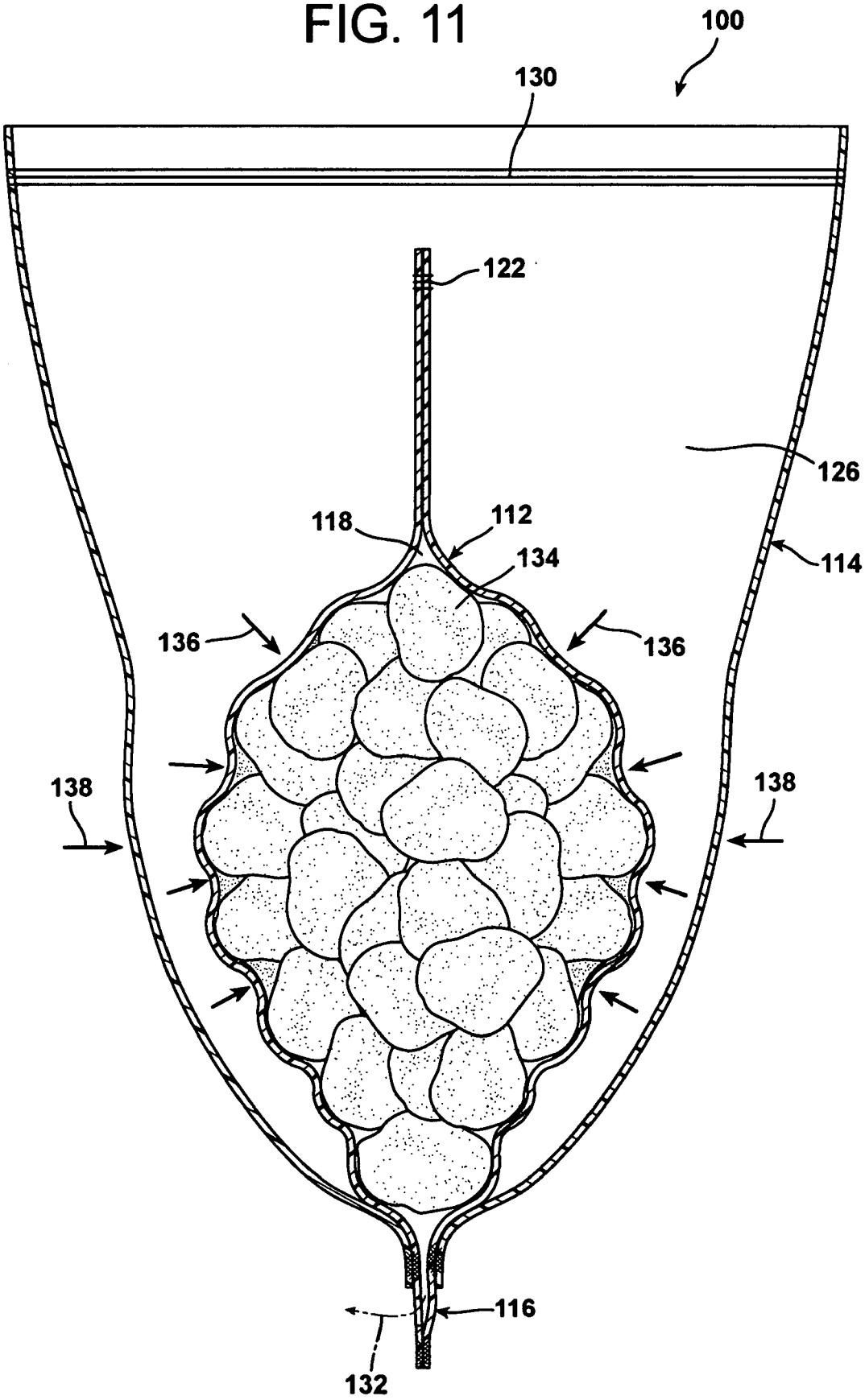
FIG. 11 is a cross-sectional view of the packaging device shown in FIG. 5, wherein pressure is applied to the outer container to urge fluid flow from the inner container via the one-way valve.

The operation of packaging device 100 is similar to that of packaging device 10 as described above, with closure mechanisms 122, 130 being movable between respective open (FIG. 5) and closed positions (FIG. 11). Inner and outer containers 112, 114 are relatively positioned such that, when the closure mechanism 122 for inner container 112 is in the closed position, a volume of ambient fluid 136, e.g., air, is trapped externally of the inner container 112 and within the interior compartment 126 of outer container 114 upon movement of the closure mechanism 130 for outer container 114 to the closed position (FIG. 11).

Figure 10:
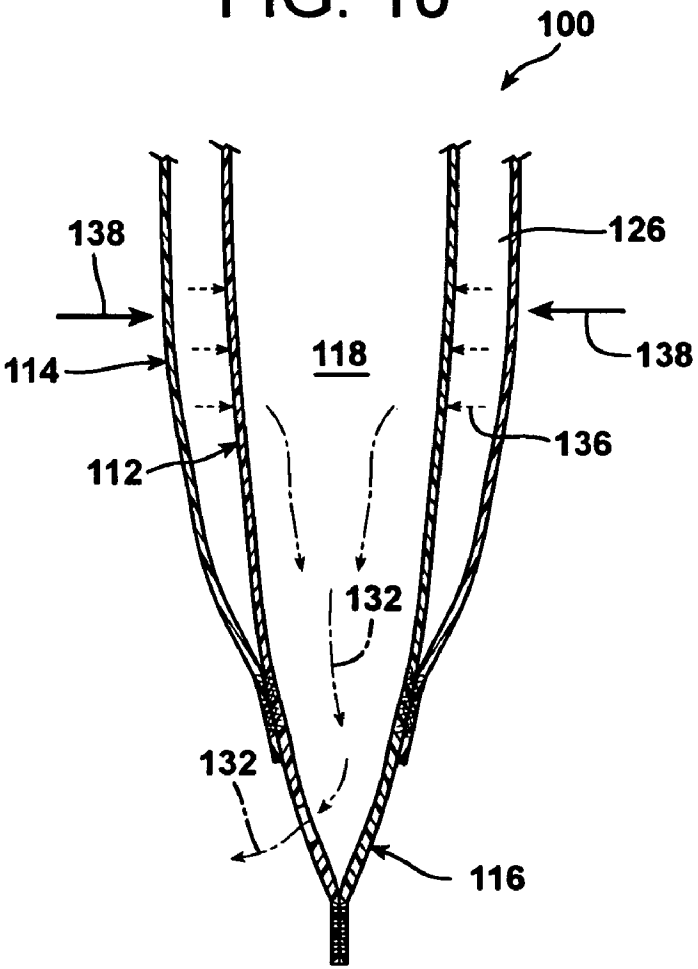
FIG. 10 is a cross-sectional view taken along line 10-10 in FIG. 6.

Accordingly, when external pressure 138 is applied to outer container 114, the ambient fluid 136 trapped within the outer container transfers such pressure to the inner container 112 (FIGS. 10-11). This transfer of pressure urges fluid flow, indicated by arrows 132, from the interior compartment 118 of inner container 112, through egress ports 124*a, b* and valve 116, and out of packaging device 100. In this manner, air or other fluid 132 in contact with packaged articles 134 is forced to flow out of the interior compartment 118 in which the articles 134 are located.

Figure 5:
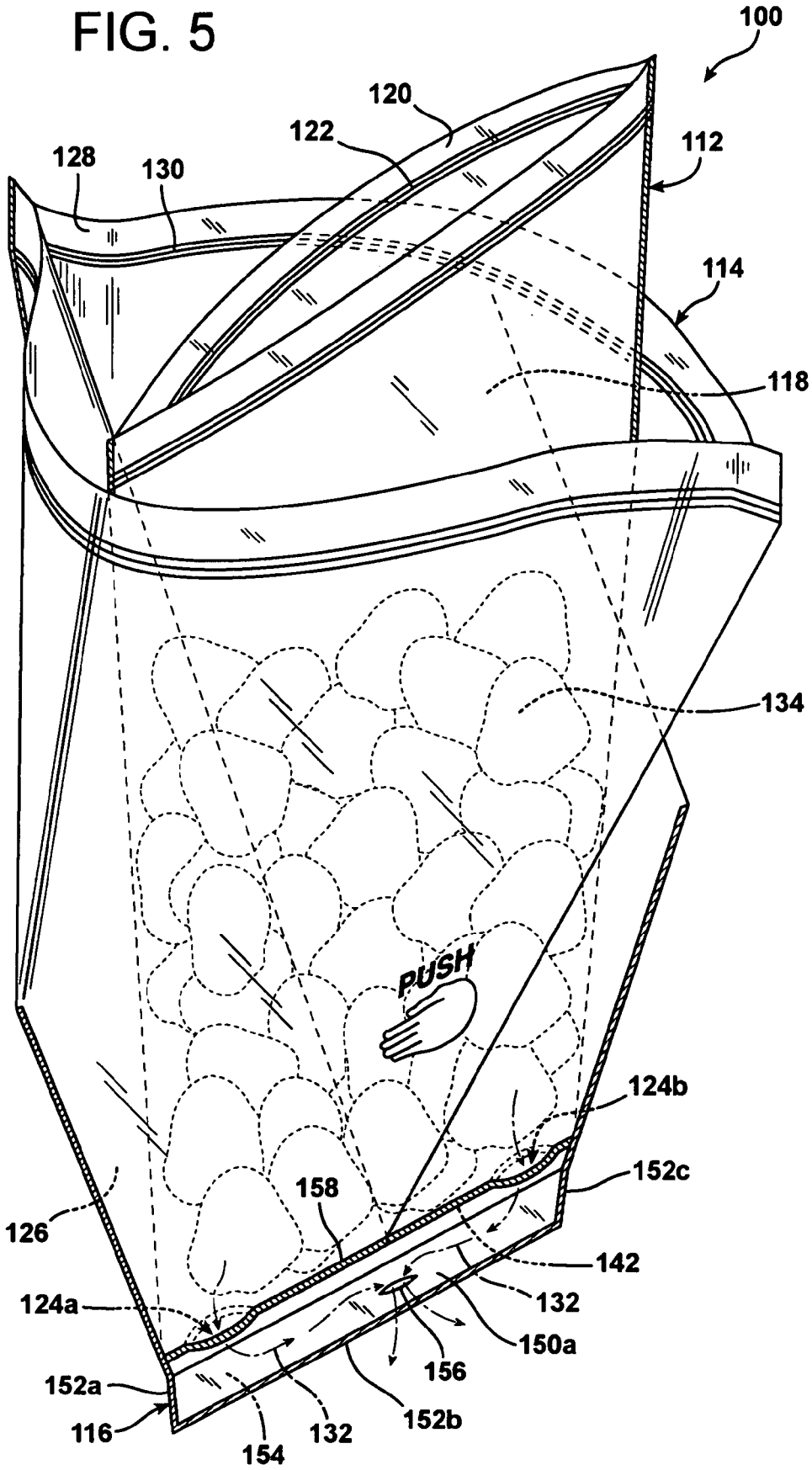
FIG. 5 is a perspective view of an alternative packaging device in accordance with the present invention.
Figure 8:
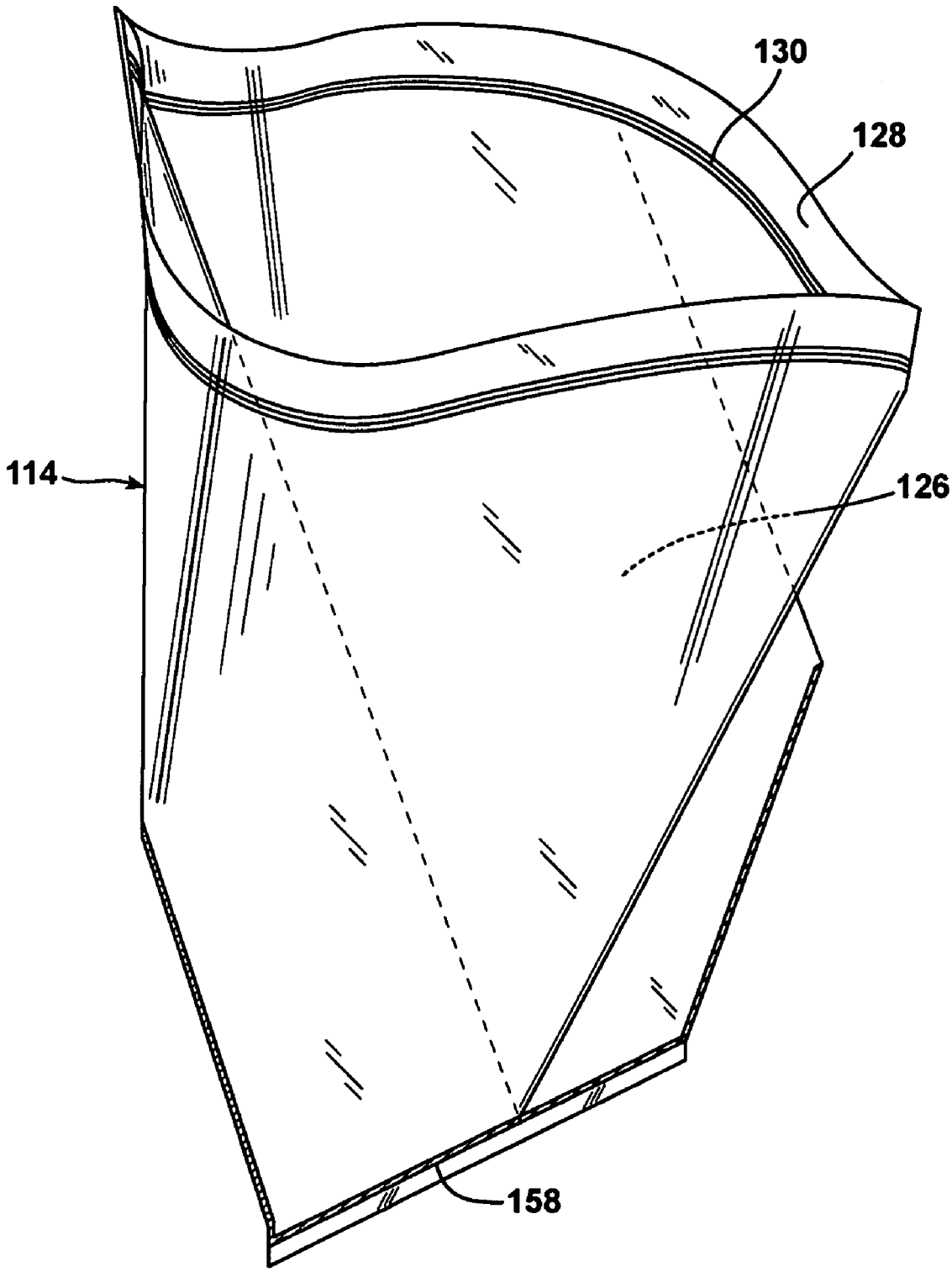
FIG. 8 is a perspective view of the outer container component of the packaging device shown in FIG. 5.

Like packaging device 10, outer container 114 of device 100 may be configured such that the opening 128 thereof is arranged at an angle relative to closed end 158 of the outer container (FIGS. 5 and 8). As shown, such angle may be approximately 90°, such that outer container has a substantially tetrahedron-shaped form. Any desired angle may be employed, ranging, e.g., from 0° to 180°, to provide any desired form to the outer container.

Unlike device 10, inner container 112 of device 100 is configured such that the opening 120 of the inner container is substantially parallel to, i.e., substantially coplanar with, closed end 142 of the inner container. Accordingly, in this embodiment, i.e., in packaging device 100, opening 120 of inner container 112 is arranged at an angle relative to opening 128 of outer container 114, e.g., 90° as shown in FIG. 5. In contrast, the openings 20, 28 of packaging device 10 are substantially parallel to one another (FIG. 1). It may thus be appreciated that the relative angular arrangement of openings 120, 128 provides an alternative means for relatively positioning the inner and outer containers 112, 114 such that a volume of ambient fluid 136 is trapped externally of inner container 112 and within the interior compartment 126 of outer container 114 when the closure mechanisms 122, 130 for inner, outer containers 112, 114 are moved to their respective closed positions. Any desired angle ranging, e.g., from 0° to 180°, between openings 120, 128 may be employed to provide any desired degree of relative positioning between the inner and outer containers 112, 114.

Figure 6:
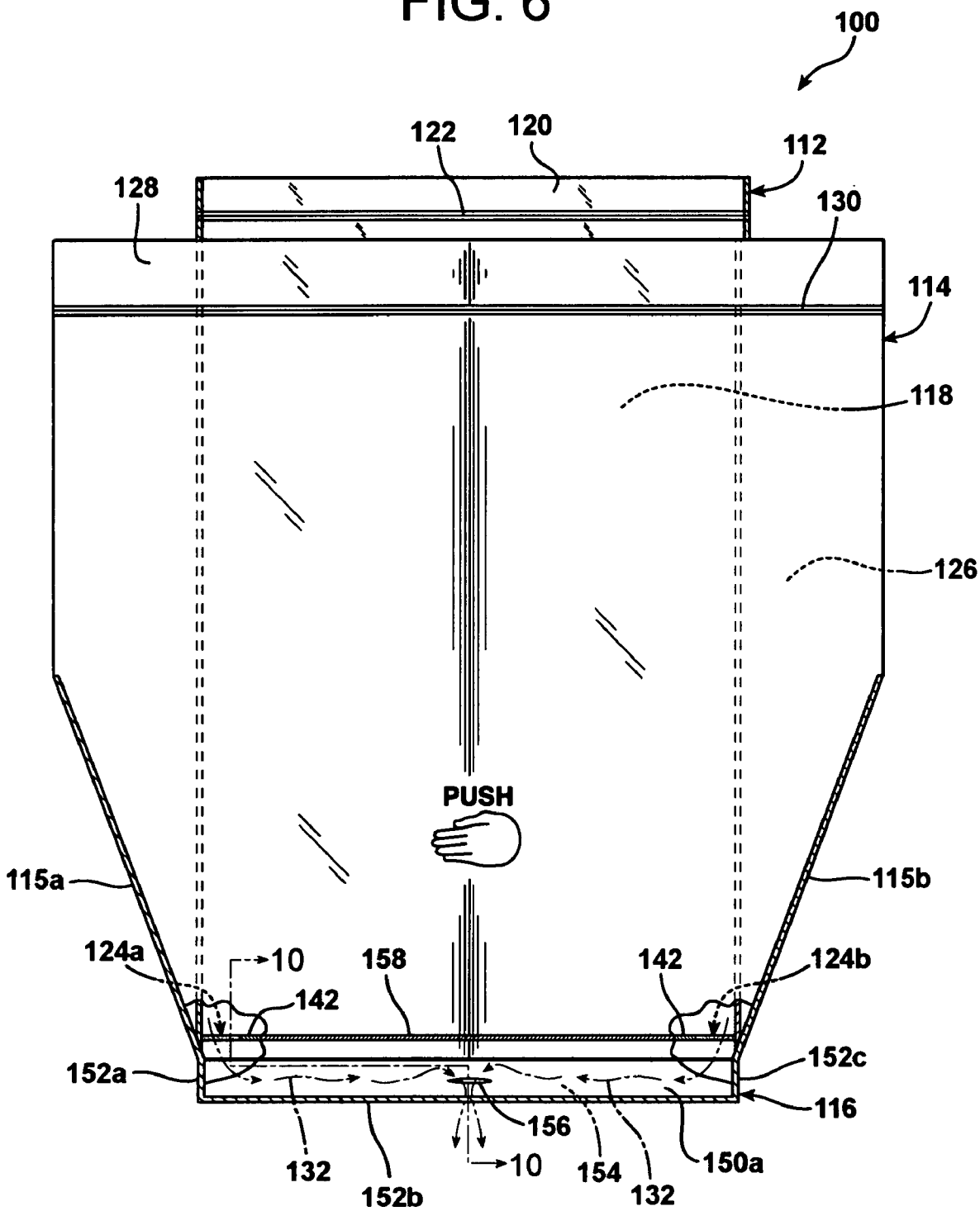
FIG. 6 is an elevational view of the packaging device shown in FIG. 5.

A further alternative means for trapping sufficient ambient fluid between the inner and outer containers is to provide the outer container with an outwardly flared shape relative to the inner container. This may be accomplished by including a pair of outwardly angled sections 115*a, b* in outer container 114 (FIG. 6).

Figure 7:
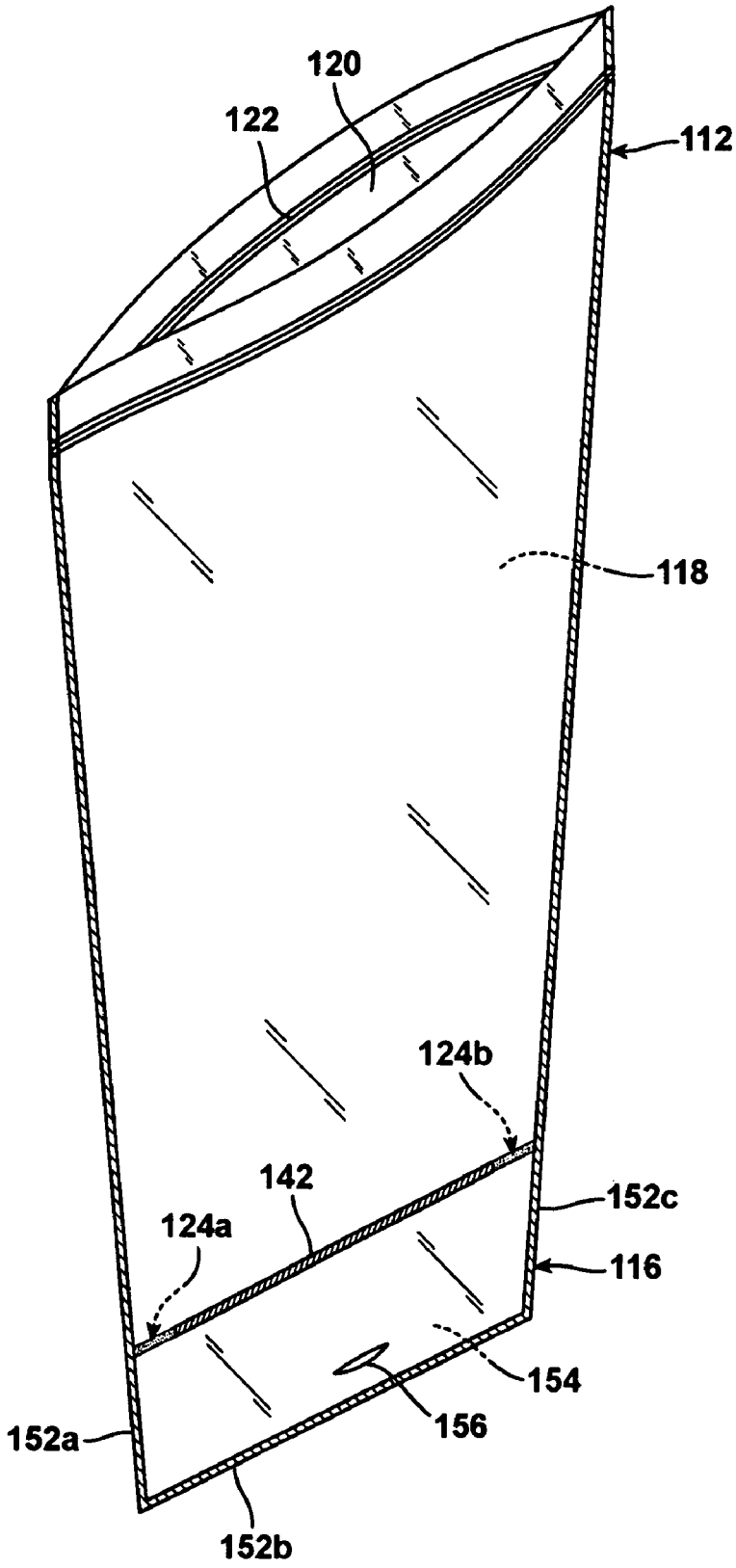
FIG. 7 is a perspective view of the inner container component of the packaging device shown in FIG. 5.

A further difference between packaging devices 10 and 100 concerns the one-way valve. Like one-way valve 16, one-way valve 116 may comprise a pair of juxtaposed film plies 150*a, b* extending from closed end 142 of inner container 112 (FIGS. 5-7). The valve may further include one or more seals 152*a*, 152*b*, and 152*c* to define a channel 154 within valve 116, and an outlet 156 in fluid communication with channel 154. In packaging device 10, outlet 56 in valve 16 is an unsealed gap between seals 52*b* and 52*c*, i.e., an unsealed section between film plies 50*a, b* at the bottom of channel 54. Alternatively, as shown in packaging device 100, outlet 156 may be in the form of a slit in one or both of film plies 150*a, b*, with channel-defining seals 152*a-c* being continuous.

Figure 16:
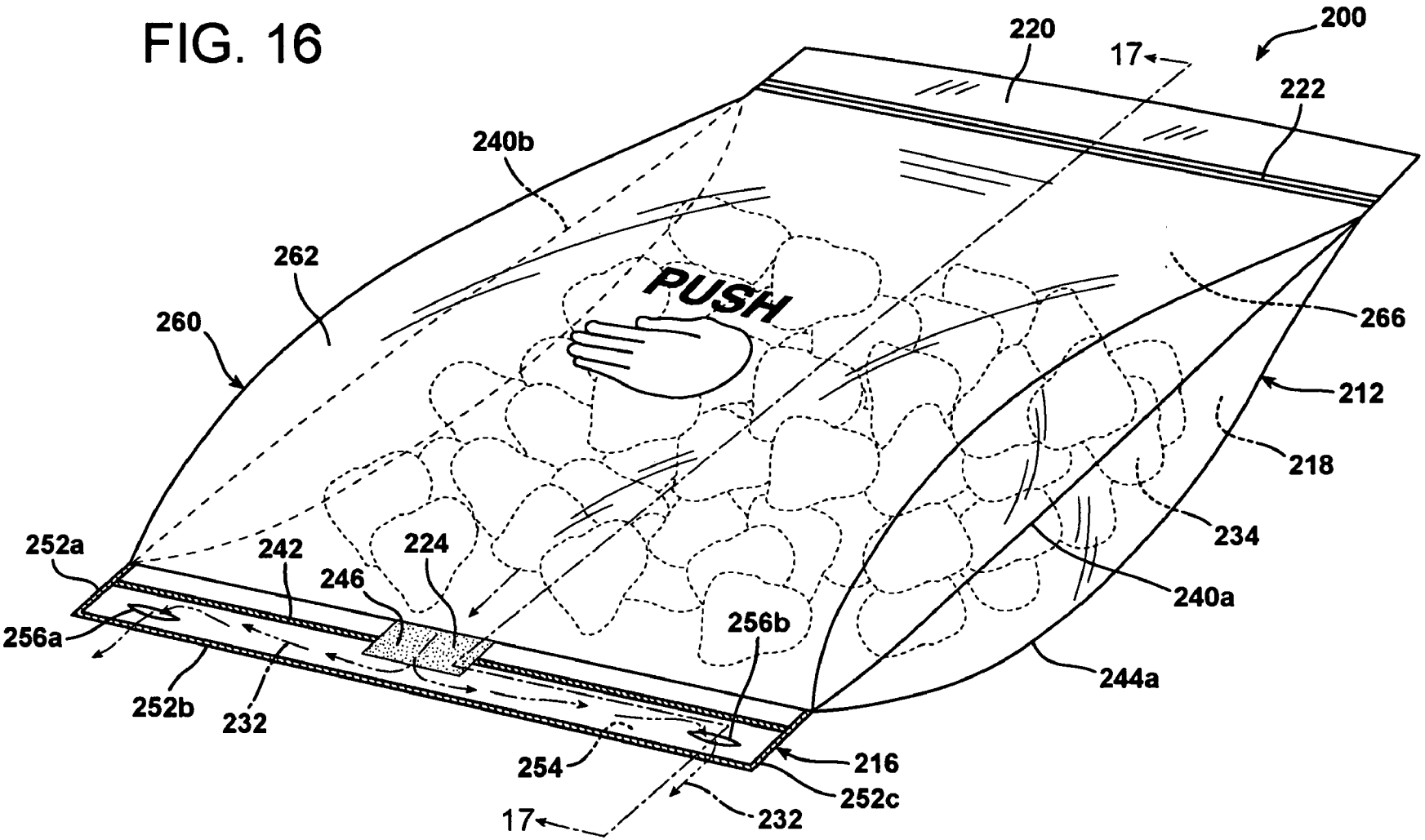
FIG. 16 is a perspective view of another alternative packaging device in accordance with the present invention.
Figure 17:
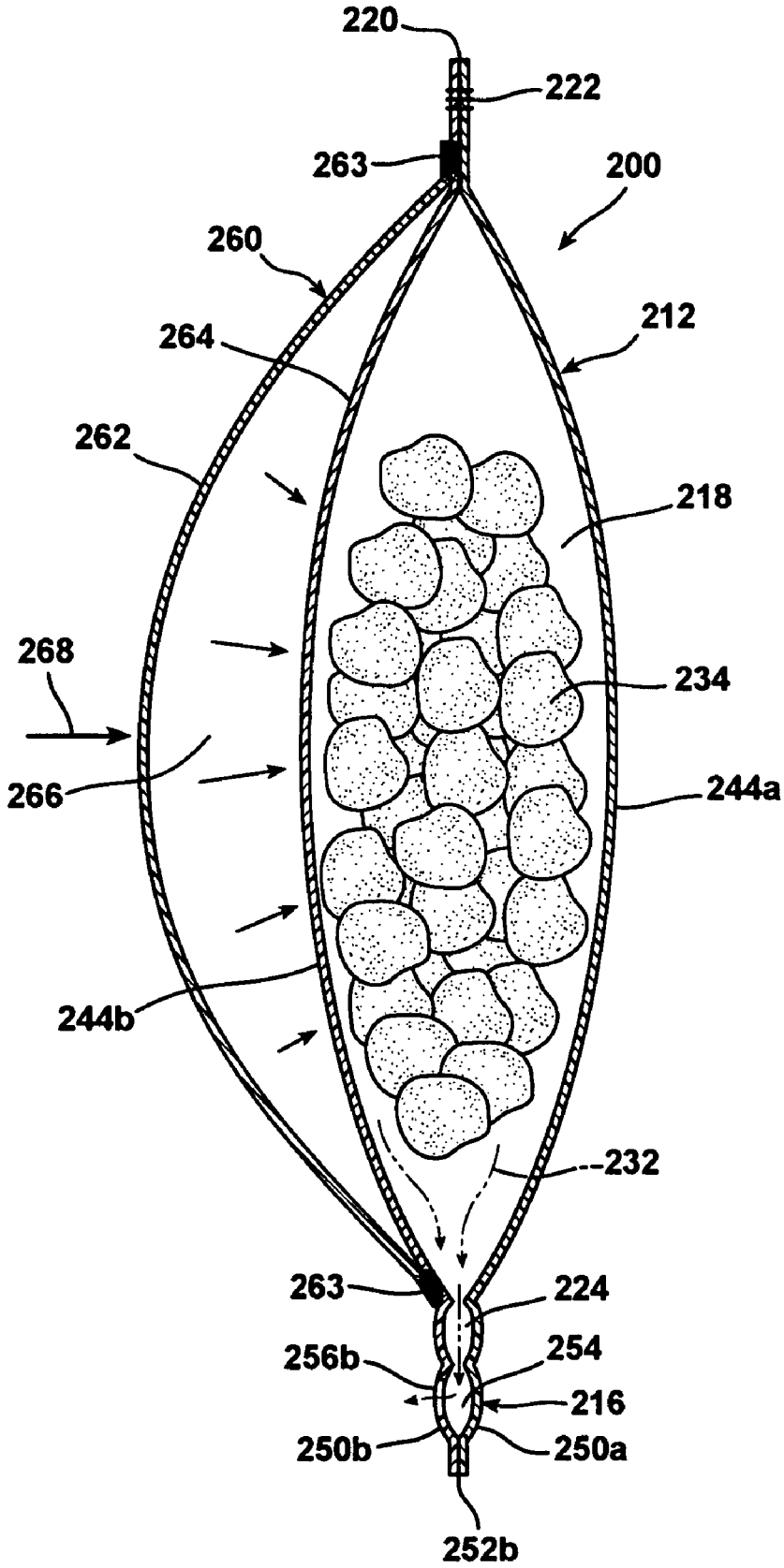
FIG. 17 is a cross-sectional view taken along line 17-17 in FIG. 16.

Referring now to FIGS. 16-17, a further embodiment of the present invention will be described. As with packaging devices 10, 100 described above, packaging device 200 includes a flexible container 212 having an interior compartment 218, an opening 220 into the interior compartment, a closure mechanism 222 for opening 220, and an egress port 224 adapted to permit fluid flow out of the interior compartment 218. Like closure mechanisms 22, 122 described above, closure mechanism 222 is movable between an open position (not shown), in which interior compartment 218 is accessible via opening 220, and a closed position (shown in FIGS. 16-17), in which interior compartment 218 is substantially inaccessible.

Similar to packaging devices 10, 100, packaging device 200 further includes a one-way valve 216 in fluid communication with egress port 224 in container 212. Valve 216 is adapted to receive fluid 232 from egress port 224 and direct the fluid out of packaging device 200.

Unlike packaging devices 10, 100, however, packaging device 200 does not include an outer container within which an inner container is located. Instead, packaging device 200 includes at least one pressure chamber 260 adjacent to flexible container 212. As shown, pressure chamber 260 comprises a flexible panel 262 sealed to an exterior surface 264 of container 212, and encloses therebetween a volume of fluid 266. Panel 262 may be sealed to exterior surface 264 via heat-seal 263. Heat-seal 263 may be formed around substantially the entire periphery of panel 262 to substantially completely enclose fluid 266 between the 262 and exterior surface 264 of container 212.

Accordingly, when closure mechanism 222 is in the closed position as shown in FIGS. 16-17, external pressure 268 applied to pressure chamber 260 transfers such pressure to container 212, as indicated by the arrows in FIG. 17, to promote fluid flow 232 from interior compartment 218 of the container, through valve 216, and out of packaging device 200. In this manner, a substantial amount of any air or other fluid trapped in interior compartment 218 with product 234 can be removed by simply pressing on the pressure chamber 260.

Flexible container 212 may comprise a pair of generally opposed film plies 244*a, b*, with interior compartment 218 defined or bounded by such film plies 244*a, b*, in conjunction with opening 220, closed end 242, and side edges 240*a, b*. In the illustrated embodiment, film ply 244*b* forms the exterior surface 264 to which flexible panel 262 is sealed. Closed end 242 may be formed by sealing, e.g. heat-sealing, the film plies 244*a, b* as shown.

In this embodiment, a single egress port 224 is included, which may be formed by a gap or unsealed segment of closed end 242, e.g., by including a non-sealable substance 246 between film plies 244*a, b* in the area shown in FIG. 16.

One-way valve 216 may comprise a pair of juxtaposed film plies 250*a, b* extending from closed end 242 of container 212. The valve may further include one or more seals 252*a*, 252*b*, and 252*c* to define a channel 254 within valve 216. In this embodiment, valve 216 includes a pair of outlets 256*a, b* in fluid communication with channel 254. Outlets 256*a, b* are in the form of openings, e.g., slits, in one or both of film plies 250*a, b*.

In the illustrated embodiment, panel 262 is depicted as being sealed to exterior surface 264 between closure mechanism 222 and closed end 242. In other embodiments, the upper edge of panel 262 may be extended upwards and sealed at a higher location on container 212, e.g., such that it is coincident with, or sealed above, closure mechanism 222. Similarly, panel 262 may also be extended downwards and sealed at a lower location on container 212, e.g., such that it is coincident with closed end 242, or sealed between closed end 242 and valve outlets 256*a, b*.

Also in the illustrated embodiment, packaging device 200 contains a single pressure chamber 260, i.e., a single panel 262 is depicted as being sealed to exterior surface 264 of container 212, i.e., to film ply 244*b*. If desired, a second flexible panel may be sealed to container 212, e.g., to film ply 244*a*, in order to provide a second, opposing pressure chamber (not shown).

Figure 18:
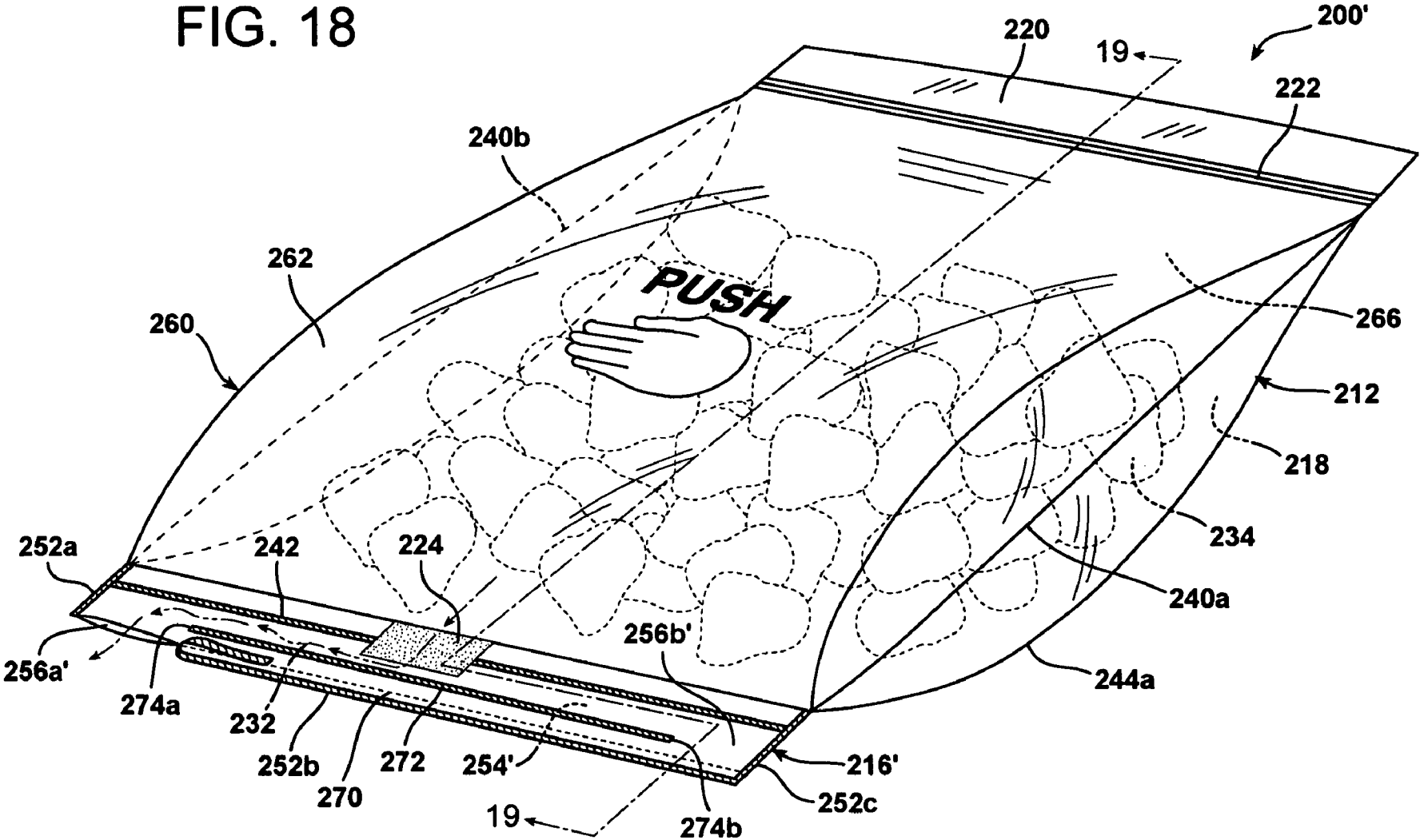
FIG. 18 is a perspective view of a further alternative packaging device in accordance with the present invention.
Figure 19:
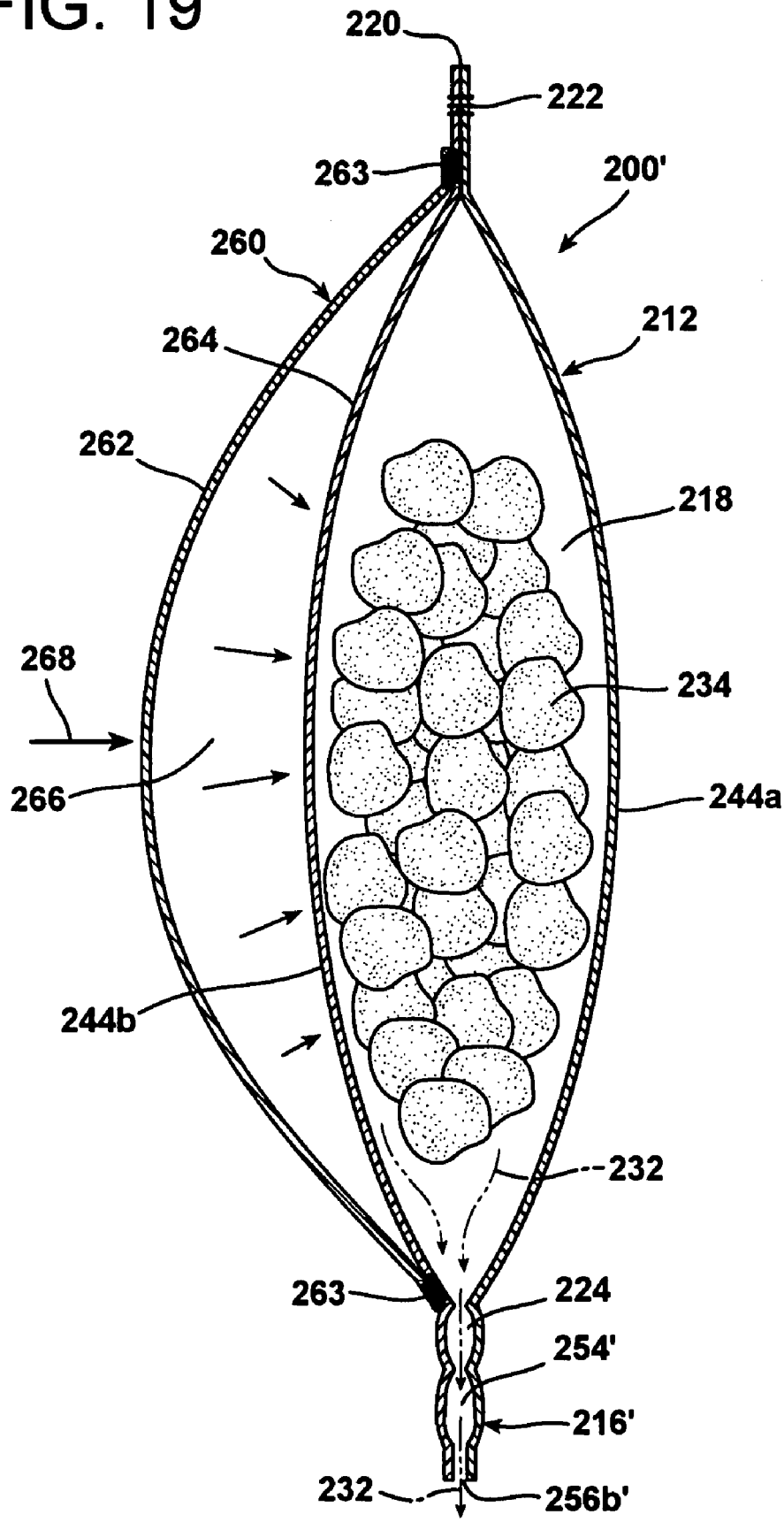
FIG. 19 is a cross-sectional view taken along line 19-19 in FIG. 18.

FIGS. 18-19 illustrates a similar packaging device 200', with an alternative valve 216'. Valve 216' includes a tear line 270 and, parallel thereto, a partial seal line 272. In this embodiment, valve channel 254' is defined between closed end 242 of interior compartment 218, and partial seal line 272. Partial seal line 272 has opposing end points 274*a, b*. As shown, end points 274*a, b* terminate a predetermined distance from respective side seals 252*a* and 252*c* of valve 216', thereby forming respective valve outlets 256*a'* and 256*b'*.

End seal 252*b* of valve 216' may be removed as shown by tearing along tear line 272, thereby exposing valve outlets 256*a'* and 256*b'*. Once this occurs, one-way valve 216' may operate as described above in connection with valve 216 (see FIG. 19). In some embodiments, tear line 272 may be useful as a tamper-evident device, wherein the removal thereof will provide an indication that the contents of packaging device 200' may have already been accessed. In other embodiments, tear line 272 may be useful to ensure that a modified atmosphere within interior compartment 218, e.g. a food-product preservation gas such as $CO_2$ or $N_2$, remains therein during distribution and retail display. Packaging devices 200, 200' may thus be particularly useful for packaging sliced deli meats.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention.

What is claimed is:

1. A packaging device, comprising:

a. a flexible inner container having (1) an interior compartment, (2) an opening into said interior compartment, (3) a closure mechanism for said opening, said closure mechanism being movable between an open position, in which said interior compartment is accessible via said opening, and a closed position, in which said interior compartment is substantially inaccessible, and (4) an egress port adapted to permit fluid flow out of said interior compartment;

b. a flexible outer container having (1) an interior compartment, (2) an opening into said interior compartment, and (3) a closure mechanism for said opening, said closure mechanism being movable between an open position, in which said interior compartment is accessible via said opening, and a closed position, in which said interior compartment is substantially inaccessible, wherein (i) said inner container is positioned within the interior compartment of said outer container such that said inner container and said opening thereof are accessible when said closure mechanism of said outer container is in said open position, and (ii) said inner and outer containers are relatively positioned such that, when the closure mechanism for said inner container is in said closed position, a volume of ambient fluid is trapped externally of said inner container and within the interior compartment of said outer container upon movement of the closure mechanism for said outer container to said closed position; and c. a one-way valve comprising two or more juxtaposed film plies joined together with one or more seals to define a channel, and an outlet in fluid communication with said channel, said outlet adapted to permit fluid flow out of said channel, said valve being in fluid communication with said egress port in said inner container, said valve adapted to receive fluid from said egress port and direct the fluid through said channel and out of said packaging device via said outlet, whereby, when pressure is applied to said outer container, the ambient fluid trapped within said outer container transfers the pressure to said inner container, thereby urging fluid flow from said interior compartment of said inner container, through said egress port and said valve, and out of said packaging device.

2. The packaging device of claim 1, wherein said inner container comprises a flexible pouch.

3. The packaging device of claim 2, wherein said pouch is formed from a polyolefin film having a thickness ranging from about 0.5 to about 50 mils.

4. The packaging device of claim 1, wherein said outer container comprises a flexible pouch.

5. The packaging device of claim 4, wherein said pouch is formed from a polyolefin film having a thickness ranging from about 0.5 to about 50 mils.

6. The packaging device of claim 1, wherein said outlet is positioned externally of said interior compartment of said inner container.

7. The packaging device of claim 1, wherein said outlet is positioned externally of said interior compartment of said outer container.

8. The packaging device of claim 1, wherein said outer container further comprises a substantially closed end spaced from said opening of said outer container such that said interior compartment of said outer container is disposed between said opening of said outer container and said closed end thereof.

9. The packaging device of claim 8, wherein said opening of said outer container is arranged at an angle relative to said closed end thereof.

10. The packaging device of claim 8, wherein said one-way valve is positioned adjacent to said closed end of said outer container.

11. The packaging device of claim 1, wherein said opening of said inner container is arranged at an angle relative to said opening of said outer container.

12. A packaging device, comprising:

a. a flexible inner container having (1) an interior compartment, (2) an opening into said interior compartment, (3) a closure mechanism for said opening, said closure mechanism being movable between an open position, in which said interior compartment is accessible via said opening, and a closed position, in which said interior compartment is substantially inaccessible, (4) a substantially closed end spaced from said opening such that said interior compartment of said inner container is disposed between said opening and said closed end, and (5) an egress port adapted to permit fluid flow out of said interior compartment;

b. a flexible outer container having (1) an interior compartment, (2) an opening into said interior compartment, and (3) a closure mechanism for said opening, said closure mechanism being movable between an open position, in which said interior compartment is accessible via said opening, and a closed position, in which said interior compartment is substantially inaccessible, wherein (i) said inner container is positioned within the interior compartment of said outer container such that said inner container and said opening thereof are accessible when said closure mechanism of said outer container is in said open position, and (ii) said inner and outer containers are relatively positioned such that, when the closure mechanism for said inner container is in said closed position, a volume of ambient fluid is trapped externally of said inner container and within the interior compartment of said outer container upon movement of the closure mechanism for said outer container to said closed position; and c. a one-way valve positioned adjacent to, and formed in part by, said closed end of said inner container, said valve being in fluid communication with said egress port in said inner container, said valve adapted to receive fluid from said egress port and direct the fluid out of said packaging device, whereby, when pressure is applied to said outer container, the ambient fluid trapped within said outer container transfers the pressure to said inner container, thereby urging fluid flow from said interior compartment of said inner container, through said egress port and said valve, and out of said packaging device.

13. The packaging device of claim 12, wherein said opening of said inner container is arranged at an angle relative to said closed end of said inner container.

14. The packaging device of claim 12, wherein said closed end of said inner container includes at least one open region, and said open region forms said egress port in said inner container.

15. The packaging device of claim 12, wherein said valve comprises a pair of juxtaposed film plies extending from said closed end of said inner container.

16. The packaging device of claim 15, wherein said valve further includes a. one or more seals to define a channel in said valve; and b. an outlet in fluid communication with said channel, said outlet adapted to permit fluid flow out of said channel.

17. A method of packaging, comprising:

a. providing a packaging device, said packaging device comprising:

1) a flexible inner container having (a) an interior compartment in which one or more articles are located, (b) an opening into said interior compartment, (c) a closure mechanism for said opening, said closure mechanism being movable between an open position, in which said interior compartment is accessible via said opening, and a closed position, in which said interior compartment is substantially inaccessible, and (d) an egress port adapted to permit fluid flow out of said interior compartment, 2) a flexible outer container having (a) an interior compartment, (b) an opening into said interior compartment, and (c) a closure mechanism for said opening, said closure mechanism being movable between an open position, in which said interior compartment is accessible via said opening, and a closed position, in which said interior compartment is substantially inaccessible, wherein (i) said inner container is positioned within the interior compartment of said outer container such that said inner container and said opening thereof are accessible when said closure mechanism of said outer container is in said open position, and (ii) said inner and outer containers are relatively positioned such that, when the closure mechanism for said inner container is in said closed position, a volume of ambient fluid is trapped externally of said inner container and within the interior compartment of said outer container upon movement of the closure mechanism for said outer container to said closed position, and 3) a one-way valve in fluid communication with said egress port in said inner container, said valve adapted to receive fluid from said egress port and direct the fluid out of said packaging device;

b. moving said closure mechanism for said inner container to said closed position, thereby enclosing the articles within said inner container;

c. moving the closure mechanism for said outer container to said closed position, thereby trapping a volume of ambient fluid within the interior compartment of said outer container, externally of said inner container; and d. applying pressure to said outer container, whereby, the ambient fluid trapped within said outer container transfers the pressure to said inner container, thereby urging fluid flow from said interior compartment of said inner container, through said egress port and said valve, and out of said packaging device.

* * * * *